US010676159B2

(12) United States Patent
Da Rold et al.

(10) Patent No.: US 10,676,159 B2
(45) Date of Patent: Jun. 9, 2020

(54) CATAMARAN HULL OF HYBRID STRUCTURE AND CRAFT USING SUCH A HULL

(71) Applicant: KAYFLO DEVELOPPEMENT, Fort de France (FR)

(72) Inventors: Laurent Da Rold, La Rochelle (FR); Jean Delaune, La Rochelle (FR); Jean-Marc Salpetrier, Fort-de-France (FR)

(73) Assignee: KAYFLO DEVELOPPEMENT, Fort de France (FR)

( * ) Notice: Subject to any disclaimer, the term of this patent is extended or adjusted under 35 U.S.C. 154(b) by 0 days.

(21) Appl. No.: 16/092,667

(22) PCT Filed: Apr. 11, 2017

(86) PCT No.: PCT/EP2017/058678

§ 371 (c)(1),
(2) Date: Oct. 10, 2018

(87) PCT Pub. No.: WO2017/178485

PCT Pub. Date: Oct. 19, 2017

(65) Prior Publication Data

US 2019/0161143 A1 May 30, 2019

(30) Foreign Application Priority Data

Apr. 11, 2016 (FR) ..... 16 53179

(51) Int. Cl.
*B63B 1/12* (2006.01)
*B63B 73/00* (2020.01)

(52) U.S. Cl.
CPC ..... *B63B 1/121* (2013.01); *B63B 1/12* (2013.01); *B63B 73/00* (2020.01); *B63B 2001/123* (2013.01)

(58) Field of Classification Search
CPC .. B63B 1/121; B63B 1/12; B63B 9/06; B63B 2001/123
See application file for complete search history.

(56) References Cited

U.S. PATENT DOCUMENTS 3,221,697 A * 12/1965 Allegretti ..... B63B 1/12 114/274
3,230,918 A * 1/1966 Compton ..... B63B 1/14 114/283

(Continued)

FOREIGN PATENT DOCUMENTS

CA 1 265 174 A 1/1990
FR 2 031 701 A5 11/1970
FR 3049923 A1 * 10/2017 ..... B63B 1/12

OTHER PUBLICATIONS

International Search Report as issued in International Patent Application No. PCT/EP2017/058678, dated Jul. 11, 2017.

(Continued)

*Primary Examiner* — S. Joseph Morano
*Assistant Examiner* — Jovon E Hayes
(74) *Attorney, Agent, or Firm* — Pillsbury Winthrop Shaw Pittman LLP

(57) ABSTRACT

A catamaran hull of hybrid structure includes a first lateral float, a second lateral float and a central float connecting the first lateral float to the second lateral float; the hull further including a first beam having a first bulkhead and a second beam having a second bulkhead, each bulkhead lying in a plane substantially perpendicular to the bow-stern line and including: a central part including a lower element intended to collaborate with a lower part of the central float; a first lateral part including a lower element intended to collaborate with a lower part of the first lateral float; a second lateral part including a lower element intended to collaborate with a lower part of the second lateral float; the hull part arranged (Continued)

between the first bulkhead and the second bulkhead defining a monobloc hull portion.

8 Claims, 3 Drawing Sheets

(56) References Cited

U.S. PATENT DOCUMENTS

| | | | | |
|---|---|---|---|---|
| 5,031,556 | A * | 7/1991 | Blee | B63B 1/042 114/288 |
| 6,397,769 | B1 * | 6/2002 | Bullmer | B63B 1/121 114/61.1 |
| 2003/0172862 | A1 * | 9/2003 | Chacon | B63B 1/121 114/61.18 |
| 2019/0161143 | A1 * | 5/2019 | Da Rold | B63B 1/12 |

OTHER PUBLICATIONS

International Preliminary Report on Patentability and the Written Opinion of the International Searching Authority as issued in International Patent Application No. PCT/EP2017/058678, dated Oct. 16, 2018.

* cited by examiner

CATAMARAN HULL OF HYBRID STRUCTURE AND CRAFT USING SUCH A HULL

CROSS REFERENCE TO RELATED APPLICATIONS

This application is the U.S. National Stage of PCT/EP2017/058678, filed Apr. 11, 2017, which in turn claims priority to French Patent Application No. 1653179 filed Apr. 11, 2016, the entire contents of all applications are incorporated herein by reference in their entireties.

TECHNICAL FIELD OF THE INVENTION

The technical field of the invention is that of boat hulls. The present invention relates to a catamaran hull and in particular a catamaran hull of hybrid structure.

TECHNOLOGICAL BACKGROUND OF THE INVENTION

A boat hull situated on a body of water is subjected to several forces that can give rise to important stresses. In calm water, the weight of the vessel and the buoyancy are balanced out and the stresses imposed on the hull are in general low. In a swell, the buoyancy is unequally spread out and the vessel then undergoes hogging or sagging according to the configuration.

When the hull is of catamaran type, the stresses are complex. Indeed, a catamaran hull is constituted of two floats connected by a platform. The forces exerted by water on the two floats may be dissymmetrical and lead to considerable stresses. In order to be able to deal with these stresses, it is known to implement maintaining structures, commonly called beams, connecting the two floats forming the hull of the catamaran. In habitable catamarans, these beams take the form of bulkheads having an inverted U-shape profile, each branch of the inverted U being housed in one of the floats of the hull.

The presence of these bulkheads conditions the internal layout of the hull and greatly limits the space available for the internal volumes. Indeed, any modification of the bulkheads consisting of the beams may have an influence on the strength of the hull faced with the different stresses mentioned previously. It is thus understood that a habitable catamaran hull makes it possible to benefit from good stability and good strength at the price of a loss of internal volume, which greatly reduces the layout possibilities of such hulls.

There thus exists a need for a hull which makes it possible to benefit from the stability of a catamaran hull while enabling the layout of large internal volumes.

SUMMARY OF THE INVENTION

The invention offers a solution to the aforementioned problems by proposing a catamaran hull of hybrid structure comprising beams each consisting of a bulkhead, said bulkheads defining one or more one-piece hull portions. Such a structure makes it possible to obtain a large internal volume in a hull having a stability close to the stability of a catamaran hull.

One aspect of the invention relates to a catamaran hull of hybrid structure comprising a first lateral float, a second lateral float and a central float joining the first lateral float to the second lateral float; the hull further including a first beam consisting of a first bulkhead and a second beam consisting of a second bulkhead each bulkhead lying in a plane substantially perpendicular to the bow-stern axis and including:

- a central portion comprising a lower element intended to cooperate with a lower portion of the central float;
- a first lateral portion comprising a lower element intended to cooperate with a lower portion of the first lateral float;
- a second lateral portion comprising a lower element intended to cooperate with a lower portion of the second lateral float;

the hull portion arranged between the first bulkhead and the second bulkhead defining a one-piece hull portion.

Substantially perpendicular is taken to mean that the angle between the bow-stern axis and the plane containing the first bulkhead or the second bulkhead is equal to 90° more or less 20°. One-piece hull portion is taken to mean a portion of the hull including the central float, a portion of the first lateral float and a portion of the second lateral float, the assembly forming a hull portion made from a single unit. In other words, the volume of the one-piece portion is defined by the first bulkhead, the second bulkhead and the external lateral walls opposite to the central float of the first lateral float and the second lateral float.

Beam is here taken to mean an element contributing to the mechanical strength of the hull. In the hull according to the invention, the first beam and the second beam are in the form of a first bulkhead and a second bulkhead. In the text of the application, the term first bulkhead is thus equivalent to the term first beam and the term second bulkhead is thus equivalent to the term second beam. It is thus understood that the first bulkhead and the second bulkhead contribute to the mechanical strength of the hull and thus must not be considered as simple bulkheads only having a role of separation between two spaces.

Thus, in a hull according to the invention, the first bulkhead and the second bulkhead make it possible to obtain a one-piece portion that has volumes similar to a monohull; the portions of the hull outside of this one-piece portion having a catamaran profile. The hull may thus be described as a catamaran hull of hybrid structure. This structure confers great stability and a large habitable volume to the whole assembly.

The invention also relates to a craft comprising a hull according to the invention.

Apart from the characteristics that have just been mentioned in the preceding paragraphs, the hull according to one aspect of the invention may have one or more additional characteristics among the following, considered individually or according to all technically possible combinations thereof.

Advantageously, the first bulkhead and/or the second bulkhead have an opening. Alternatively, the first bulkhead and/or the second bulkhead have a plurality of openings. Thus, external light can penetrate into the space comprised between the first bulkhead and the second bulkhead which limits resorting to artificial lighting. This further makes it possible to ensure natural ventilation of this same space.

Advantageously, the one-piece hull portion comprises a lower portion defining a hull bottom of the one-piece hull portion; said hull bottom being totally immersed. Thus, the volume of the hull portion defined between the first bulkhead and the second bulkhead is maximised.

Alternatively, the one-piece hull portion comprises a lower portion defining a hull bottom of the one-piece hull portion; said hull bottom being partially immersed. Thus, it is possible to provide a passage for the flow of water at the level of the central portion of the hull. The hydrodynamics of the hull are thereby improved.

Advantageously, the hull comprises a plurality of central floats, a plurality of first beams each first beam being constituted of a first bulkhead, a plurality of second beams each second beam being constituted of a second bulkhead, the central portion of each bulkhead comprising a lower element intended to cooperate with a lower portion of a central float of the plurality of central floats; each hull portion arranged between a first bulkhead and a second bulkhead defining a one-piece hull portion so as to form a plurality of one-piece hull portions.

Thus the plurality of first beams corresponds to a plurality of first bulkheads. Similarly, the plurality of second beams corresponds to a plurality of second bulkheads. Each hull portion arranged between a first bulkhead of the plurality of first bulkheads and a second bulkhead of the plurality of second bulkheads defines a one-piece hull portion. The plurality of first bulkheads and the plurality of second bulkheads thereby form a plurality of one-piece hull portions. In addition, each bulkhead of the plurality of first bulkheads or of the plurality of second bulkheads includes a central portion comprising a lower element intended to cooperate with a lower portion of a central float of the plurality of central floats.

In other words, each first bulkhead of the plurality of first bulkheads is associated with a second bulkhead of the plurality of second bulkheads and with a central float of the plurality of central floats to form a one-piece hull portion. It is thus possible to provide a plurality of monohull type volumes within the hull according to the invention.

Advantageously, a fourth beam is arranged horizontally at the level of the rear portion of the hull so as to be positioned between the first lateral float and the second lateral float, said fourth beam including a first end joining the fourth beam to the first lateral float and a second end joining the fourth beam to the second lateral float.

Thus, this fourth beam, situated outside of the floats, reinforces the rigidity of the hull on the catamaran portion of the hull while enabling the layout of a large quarter deck on an upper surface of the fourth beam, the fourth beam being arranged horizontally. Such a quarter deck notably makes it possible to facilitate access to the sea or to land. "Arranged horizontally" is taken to mean the fact that the fourth beam defines a first plane, said first plane being parallel to the water plane. "Water plane" is taken to mean the plane passing through the water line.

The invention and its different applications will be better understood on reading the description that follows and by examining the figures that accompany it.

BRIEF DESCRIPTION OF THE FIGURES

The figures are presented for indicative purposes and in no way limit the invention. They illustrate.

DETAILED DESCRIPTION OF AT LEAST ONE EMBODIMENT OF THE INVENTION

Unless stated otherwise, a same element appearing in the different figures has a single reference.

Figure 1A:
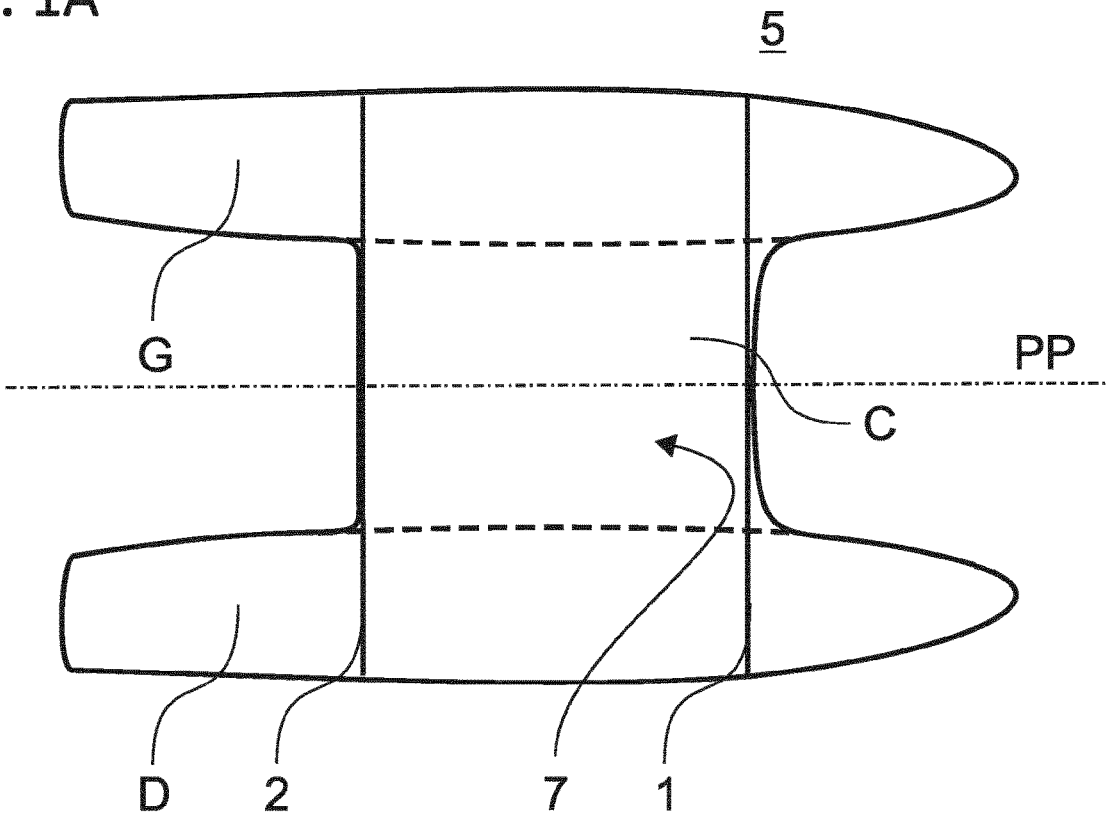
FIG. 1A, a top sectional view of a hull according to a first embodiment.
Figure 1B:
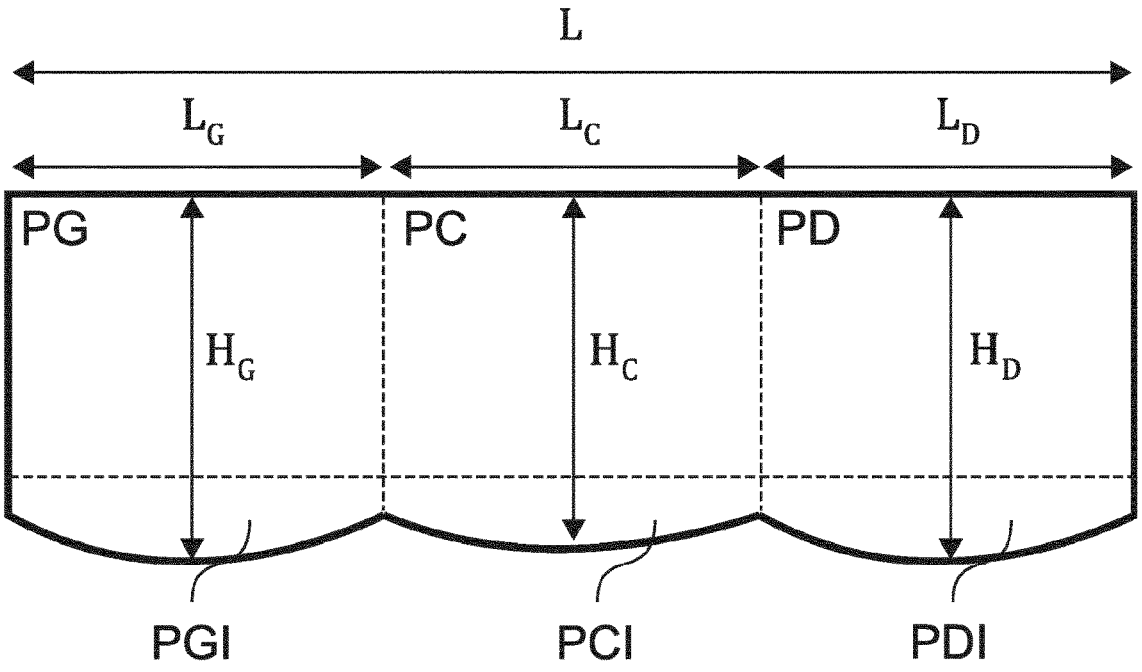
FIG. 1B, the structure of a beam according to one embodiment.

According to a first embodiment illustrated in FIGS. 1A and 1B, the invention relates to a catamaran hull 5 of hybrid structure comprising a first lateral float D, a second lateral float G and a central float C joining the first lateral float D to the second lateral float G; the hull 5 further including a first beam consisting of a first bulkhead 1 and a second beam consisting of a second bulkhead 2 each bulkhead lying in a plane substantially perpendicular to the bow-stern axis PP and including:

- a central portion PC comprising a lower element PCI intended to cooperate with a lower portion of the central float C;
- a first lateral portion PD comprising a lower element PDI intended to cooperate with a lower portion of the first lateral float D;
- a second lateral portion PG comprising a lower element PGI intended to cooperate with a lower portion of the second lateral float G;

the hull portion arranged between the first bulkhead 1 and the second bulkhead 2 defining a one-piece hull portion 7.

Thus, the first bulkhead 1 and the second bulkhead 2 make it possible to obtain a one-piece portion 7 of hull 5 which has a profile similar to a monohull. The hull 5 may be described as hybrid since the one-piece hull portion 7 of the hull 5 has a monohull profile whereas the hull portion or portions not comprised in the one-piece portion 7 have a catamaran profile.

As illustrated in FIG. 1B, each bulkhead 1, 2 has a height H and a width L. The dimensions of the first bulkhead may be different from the dimensions of the second bulkhead. Alternatively, these dimensions may be identical. The first lateral portion has a width $L_G$ and a height $H_G$, the central portion has a width $L_C$ and a height $H_C$ whereas the second lateral portion has a width $L_D$ and a height $H_D$. The height of the bulkhead H is defined as equal to $H=\max(H_C, H_D, H_G)$.

In one embodiment, the first bulkhead 1 and the second bulkhead 2 are substantially rectangular. In other words, the surface of each bulkhead of width L and of height H is equal, to more or less 20%, to the surface of a rectangle of width L and of height H. The volume obtained between the first bulkhead 1 and the second bulkhead 2 then has a substantially parallelepiped shape which makes it possible to facilitate the internal layout of said volume.

Figure 2:
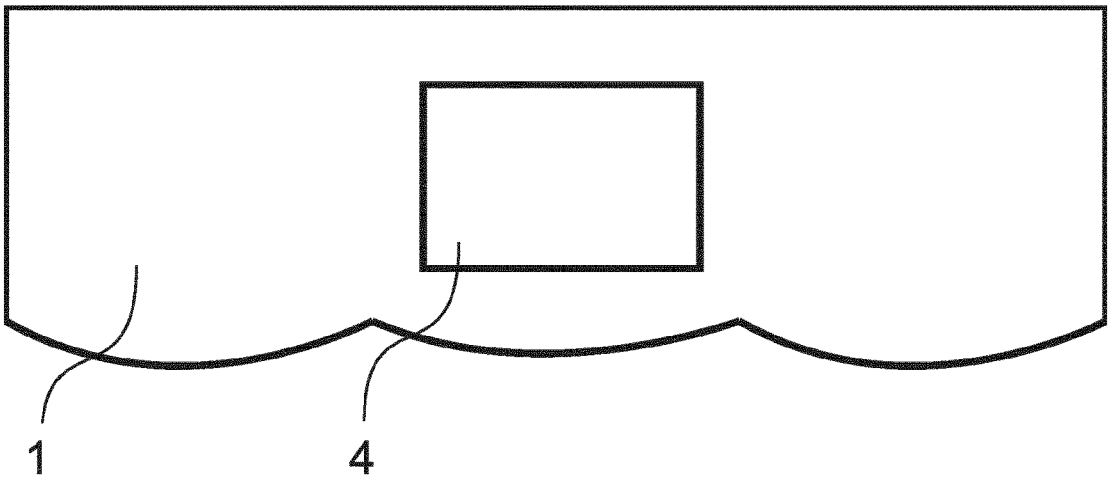
FIG. 2, the structure of a beam having an opening according to one embodiment.

In one embodiment illustrated in FIG. 2, the first bulkhead 1 has an opening 4. This opening 4 enables external light to penetrate into at least one portion of the volume defined between the first bulkhead 1 and the second bulkhead 2. It also enables natural ventilation of this same volume.

The stresses exerted on the bulkhead being mainly situated at the level of the upper and lower portions of the bulkhead, the layout of an opening 4 in the first bulkhead 1 only slightly reduces the mechanical strength of this first bulkhead 1. It is also possible to arrange a plurality of openings 4 on a same bulkhead. In the drawings, only the first bulkhead 1 has an opening 4. But it is possible to arrange an opening 4 or a plurality of openings 4 in the second bulkhead 2 or instead a first opening or a first plurality of openings in the first bulkhead 1 as well as a second opening or a second plurality of second openings in the second bulkhead 2.

In one embodiment, the first bulkhead 1 and the second bulkhead 2 are positioned such that the one-piece hull portion 7 is situated at the front of the hull 5. In this embodiment, the hybrid catamaran hull 5 has a monohull profile at the front of the hull 5 and a catamaran profile at the rear of the hull 5.

Alternatively, the first bulkhead 1 and the second bulkhead 2 are positioned such that the one-piece hull portion 7 is situated at the rear of the hull 5. In this embodiment, the hybrid catamaran hull 5 has a monohull profile at the rear of the hull 5 and a catamaran profile at the front of the hull 5.

Figure 3:
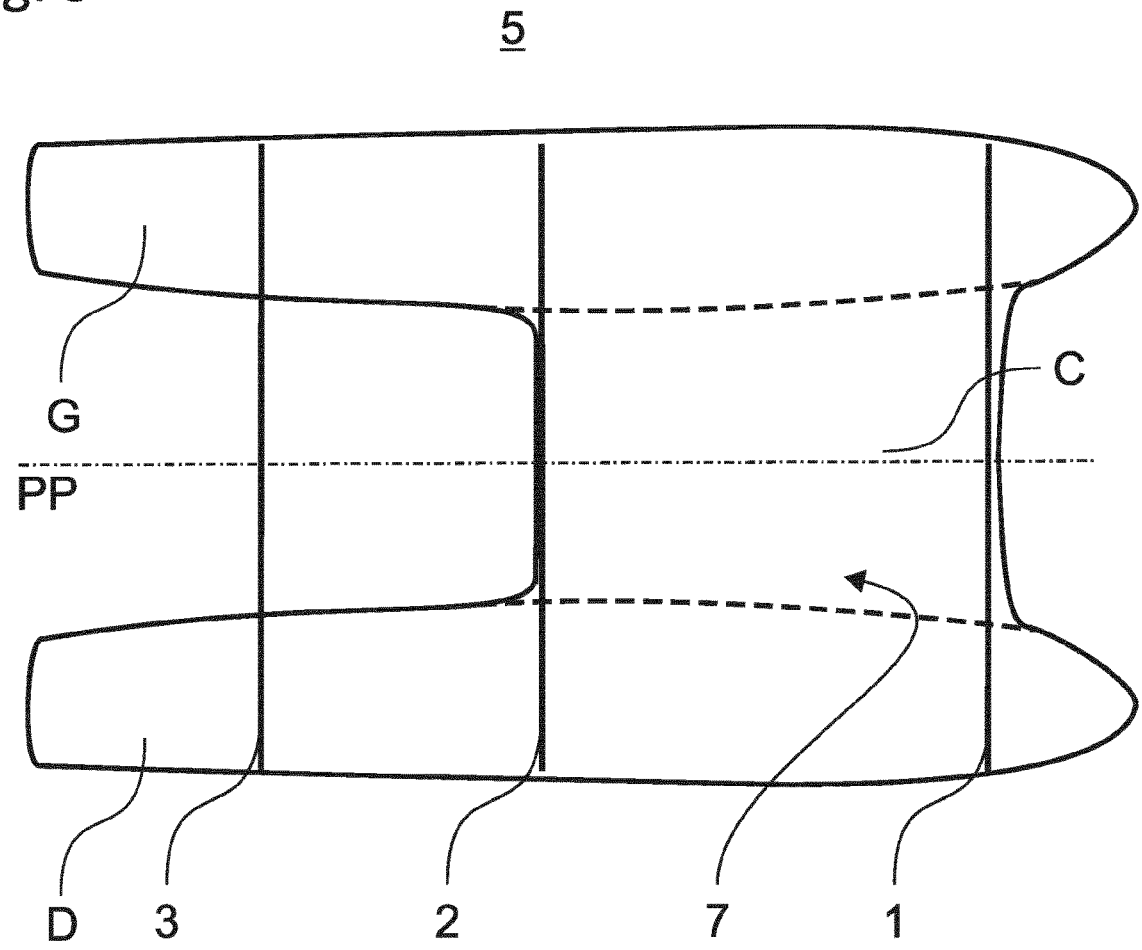
FIG. 3, a top sectional view a hull according to a second embodiment.

In one embodiment illustrated in FIG. 3, a third beam 3 mechanically strengthens the rear portion of the hull 5. Indeed, when it is wished to arrange the one-piece portion 7 of the hull 5 so as to obtain a large volume at the front of the hull 5, the first bulkhead 1 and the second bulkhead 2 are then both found arranged at the front of the hull 5. This can lead to a weakness at the level of the rear of the hull 5 in which no beam is present. The addition of a third beam 3 makes it possible to strengthen the rear of the hull 5 while conserving a hybrid structure, the hull portion 5 situated between the second bulkhead 2 and the third beam 3 having the profile of a catamaran hull. The third beam 3 thus has a similar shape to a beam employed in catamaran hulls according to the prior art.

In one embodiment, a fourth beam 8 is arranged horizontally at the level of the rear portion of the hull 5 so as to be positioned between the first lateral float D and the second lateral float G, said fourth beam including a first end joining the fourth beam to the first lateral float D and a second end joining the fourth beam to the second lateral float G.

In one embodiment, the fourth beam 8 is in the form of a central parallelepiped portion, a first end portion and a second end portion, said end portions forming an angle with the central piece, the central portion being situated in a plane parallel to the water plane. The central portion, the first end portion and the second end portion constituting a single mechanical piece. In this embodiment, the first end joining the first lateral float D is one end of the first end portion and the second end joining the second lateral float G is one end of the second end portion.

In one embodiment, the distance separating the fourth beam 8 from the stern is less than or equal to 1 m. Preferably, the width of the beam 8 is comprised between 0.5 m and 2.5 m. In one embodiment, the distance separating the fourth beam from the water plane is comprised between 10 cm and 70 cm.

In an alternative embodiment, a plurality of third beams 3 is provided. This plurality of third beams 3 strengthens the catamaran portion of the catamaran hull 5 of hybrid structure. This embodiment is particularly advantageous when the catamaran portion of the catamaran hull 5 of hybrid structure is too long for a single third beam 3 to suffice to make said catamaran portion rigid.

In one embodiment, a third beam of the plurality of third beams 3 is arranged at the rear of the hull 5 so as to form the rear end of said hull 5, said third beam comprising a flattened upper portion forming a link between the first lateral float D and the second lateral float G. In other words, said third beam constitutes the stern plate of the first lateral float D and the second lateral float G so as to form a quarter deck over the whole width of the hull 5, at the level of said third beam. Such a quarter deck notably facilitates access to the sea or to land.

Figure 4:
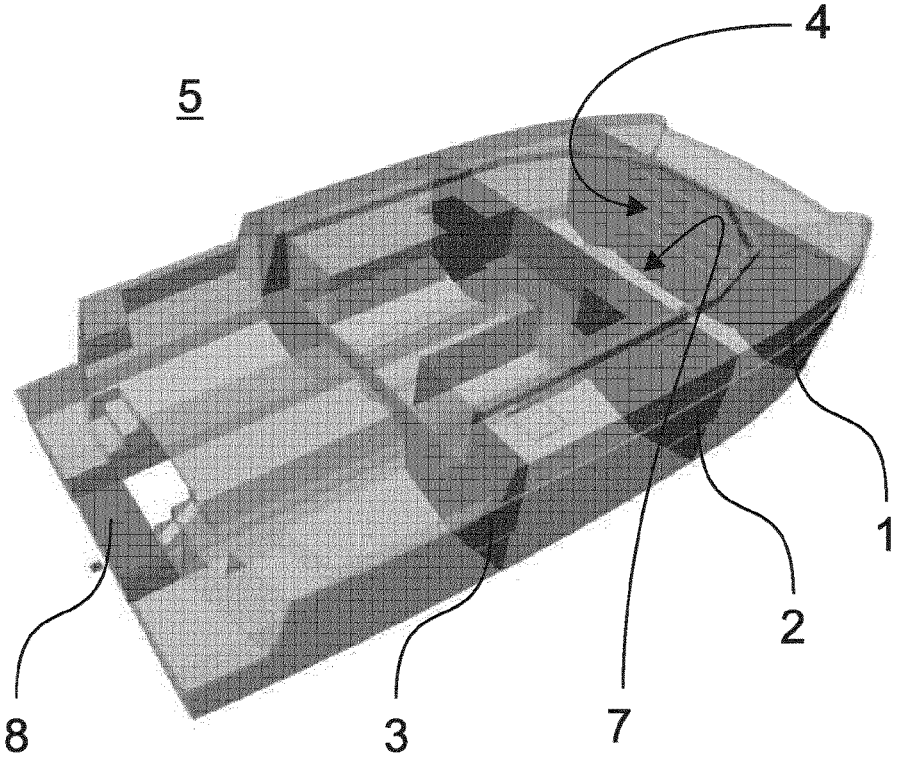
FIG. 4, a three dimensional representation of a hull according to a third embodiment.

In one embodiment illustrated in FIG. 4, in a similar manner to the embodiment of FIG. 3, a third beam 3 mechanically strengthens the rear portion of the hull 5. Moreover, the first bulkhead comprises an opening. In this embodiment, the first bulkhead is positioned at 90% of the length of the hull; the second bulkhead is positioned at 75% of the length of the hull. The third beam is positioned at 40% of the length of the hull so as to strengthen the rear portion of the hull.

First bulkhead positioned at 90% of the length of the hull is taken to mean that a distance equal to 90% of the total length of the hull separates the rear of the hull from the position of the first bulkhead. Similarly, second bulkhead positioned at 75% of the length of the hull is taken to mean that a distance equal to 75% of the total length of the hull separates the rear of the hull from the position of the second bulkhead. Similarly, third beam positioned at 40% of the length of the hull is taken to mean that a distance equal to 40% of the total length of the hull separates the rear of the hull from the position of the third beam.

As mentioned previously, the hull 5 may comprise a plurality of central floats, a plurality of first beams each first beam being constituted of a first bulkhead, a plurality of second beams each second beam being constituted of a second bulkhead, the central portion of each bulkhead comprising a lower element intended to cooperate with a lower portion of the central float of the plurality of central floats; each hull portion arranged between a first bulkhead and a second bulkhead defining a one-piece hull portion so as to form a plurality of one-piece hull portions. In this configuration, it is thus possible to provide a plurality of volumes of monohull type within the hull 5.

Figure 5:
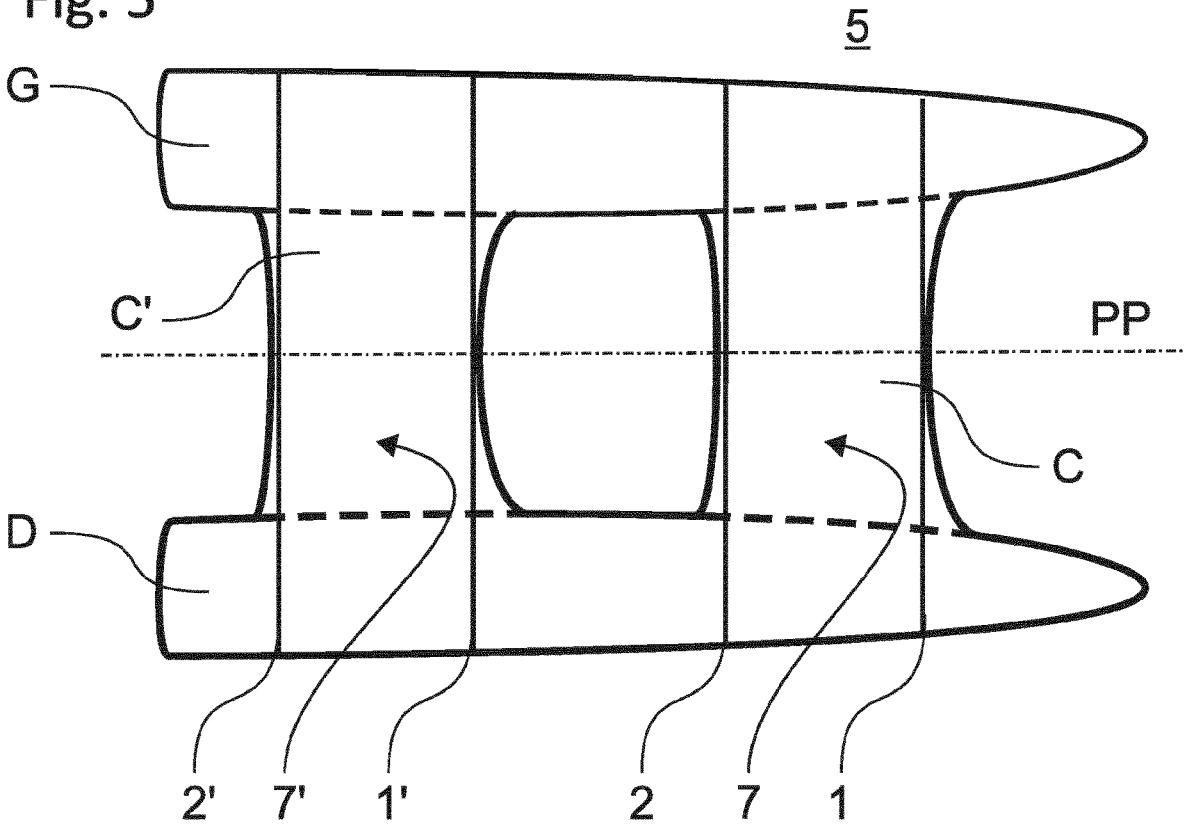
FIG. 5, a top sectional view of a hull according to a fourth embodiment.

In one embodiment illustrated in FIG. 5, two one-piece hull portions 7, 7' are provided. To do so, in this embodiment, the hull comprises a first central float C, a second central float C', a first bulkhead 1, a second bulkhead 2, a third bulkhead 1' and a fourth bulkhead 2'; each one-piece hull portion 7, 7' being arranged between a first bulkhead 1, 1' and a second bulkhead 2, 2'. The first lateral float D and the second lateral float G are thus joined by means of a first central float C and a second central float C'.

More specifically, the lower element of the central portion PC of the first bulkhead 1 and the second bulkhead 2 cooperates with a lower portion of the first central float 7. The lower element of the first lateral portion of the first bulkhead 1 and the second bulkhead 2 cooperates with a lower portion of the first lateral float D. The lower element of the second lateral portion PG of the first bulkhead 1 and the second bulkhead 2 cooperates with a lower portion of the second lateral float G. Similarly, the lower element of the central portion PC of the third bulkhead 1' and the fourth bulkhead 2' cooperates with a lower portion of the second central float 7'. The lower element of the first lateral portion of the third bulkhead 1' and the fourth bulkhead 2' cooperates with a lower portion of the first lateral float D. The lower element of the second lateral portion PG of the third bulkhead 1' and the fourth bulkhead 2' cooperates with a lower portion of the second lateral float G.

Thus, the hull portion arranged between the first bulkhead 1 and the second bulkhead 2 defines a first one-piece hull portion 7 whereas the hull portion arranged between the third bulkhead 1' and the fourth bulkhead 2' defines a second one-piece hull portion 7'.

The invention claimed is:

1. A catamaran hull of hybrid structure comprising:

a first lateral float and a second lateral float;

a central float joining the first lateral float to the second lateral float;

a first beam consisting of a first bulkhead and a second beam consisting of a second bulkhead, each of the first and second bulkheads lying in a plane substantially perpendicular to a bow-stern axis and including:

a central portion comprising a lower element configured to extend into and engage with a lower portion of the central float;

a first lateral portion comprising a lower element configured to extend into and engage with a lower portion of the first lateral float;

a second lateral portion comprising a lower element configured to extend into and engage with a lower portion of the second lateral float;

the hull portion arranged between the first bulkhead and the second bulkhead defining a one-piece hull portion.

2. The catamaran hull according to claim 1, wherein the first bulkhead and/or the second bulkhead have an opening.

3. The catamaran hull according to claim 1, wherein the first bulkhead and/or the second bulkhead have a plurality of openings.

4. The catamaran hull according to claim 1, wherein the one-piece hull portion comprises a lower portion defining a hull bottom of the one-piece hull portion; said hull bottom being totally immersed when the catamaran hull is provided on a body of water.

5. The catamaran hull according to claim 1, wherein the one-piece hull portion comprises a lower portion defining a hull bottom of the one-piece hull portion; said hull bottom being partially immersed when the catamaran hull is provided on a body of water.

6. The catamaran hull according to claim 1, comprising a plurality of central floats, a plurality of first beams each first beam being constituted of a first bulkhead, a plurality of second beams each second beam being constituted of a second bulkhead, the central portion of each bulkhead comprising a lower element configured to extend into and engage with a lower portion of the central float of the plurality of central floats; each hull portion arranged between a first bulkhead and a second bulkhead defining a one-piece hull portion so as to form a plurality of one-piece hull portions.

7. The catamaran hull according to claim 1 further comprising a fourth beam arranged horizontally at the level of the rear portion of the hull so as to be positioned between the first lateral float and the second lateral float, said fourth beam including a first end joining the fourth beam to the first lateral float and a second end joining the fourth beam to the second lateral float.

8. A craft comprising a hull according to claim 1.

* * * * *